United States Patent [19]

Anderson

[11] 4,271,332

[45] Jun. 2, 1981

[54] SPEECH SIGNAL A/D CONVERTER USING AN INSTANTANEOUSLY-VARIABLE BANDWIDTH FILTER

[76] Inventor: James C. Anderson, 1 Mohegan Rd., Acton, Mass. 01720

[21] Appl. No.: 45,282

[22] Filed: Jun. 4, 1979

[51] Int. Cl.[3] ..... G10L 1/00

[52] U.S. Cl. ..... 179/1.5 A; 179/15.55 R; 330/107; 330/110; 333/14

[58] Field of Search ..... 179/1.5 A, 1 D, 15.55 R; 332/11 D; 333/14, 174; 307/230, 237; 330/107, 110

[56] References Cited

U.S. PATENT DOCUMENTS

| | | | |
|---|---|---|---|
| 2,262,846 | 11/1941 | Herold | 179/1 D |
| 3,832,536 | 8/1974 | Le Dily et al. | 330/110 |
| 3,937,897 | 2/1976 | Song | 332/11 D |

OTHER PUBLICATIONS

J. Graeme et al., "Operational Amplifiers", McGraw Hill, 1971, p. 266.

J. Licklider et al., "Effects of Differentiation, etc., Upon Intelligibility of Speech", J. Ac. Soc. Am., Jan. 1948, pp. 42–51.

J. Licklider, "The Intelligibility of . . . Speech Waves", J. Ac. Soc. Am., Nov. 1950, pp. 820–823.

Catalog, "ECL 2 and ECL 10K", Signetics Corp., 1973, Nos. 10124, 10125 specs. only.

*Primary Examiner*—Charles E. Atkinson
*Assistant Examiner*—E. S. Kemeny
*Attorney, Agent, or Firm*—Martin M. Santa

[57] ABSTRACT

In a preferred embodiment of the invention the audio signal is bandwidth limited before being differentiated to provide either a positive or negative signal (depending on the slope of the audio signal) to a comparator which provides a corresponding logical one or zero at its output. A digital logic circuit connected to the comparator output is clocked to provide a digital output signal transition from a logical one to a zero or vice versa if its input has changed from a logical one to a zero or vice versa at least once during the clock period. The clocked digital output of the logic circuit is provided as an input to a computer where it is stored. The digital data is subsequently read out of the computer and provided to a filter and integrator to provide an audio signal replica of the filtered input audio signal.

6 Claims, 4 Drawing Figures

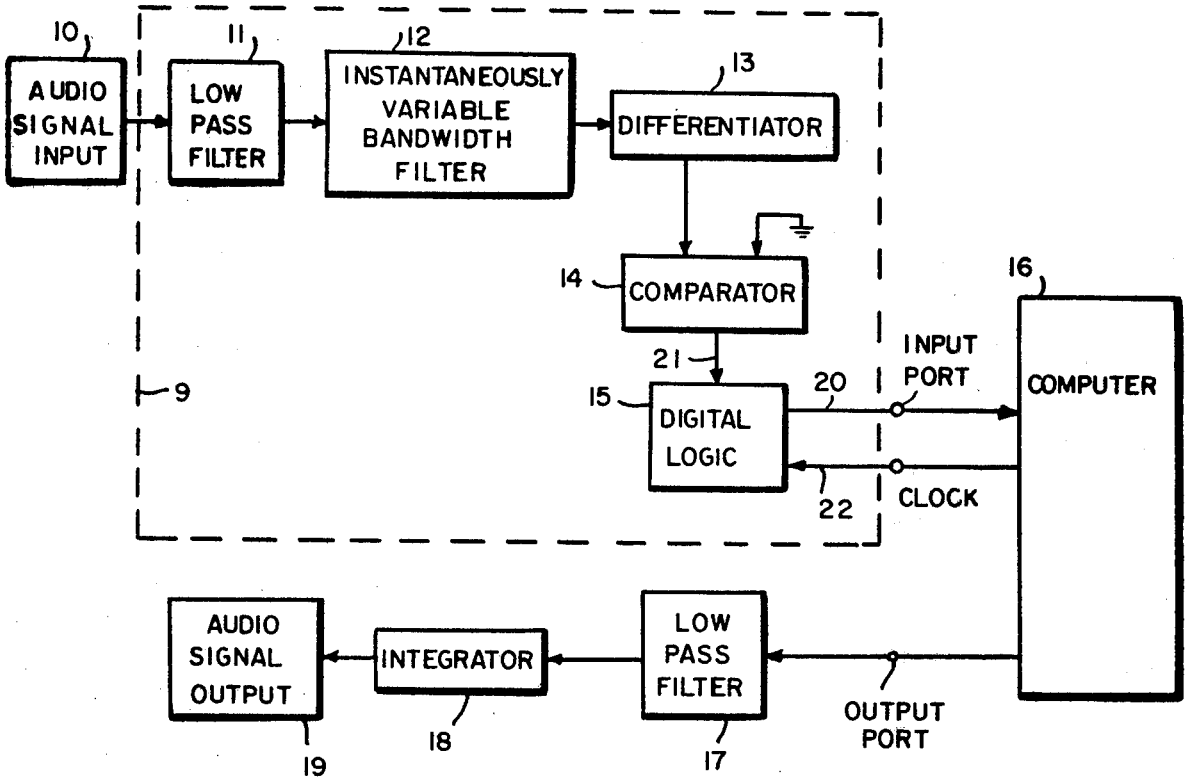
FIG. 1
FIG. 2
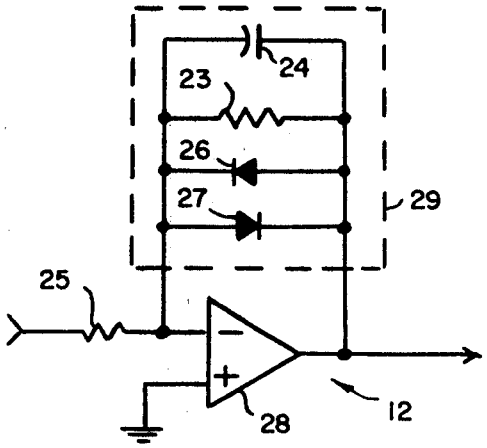

SPEECH SIGNAL A/D CONVERTER USING AN INSTANTANEOUSLY-VARIABLE BANDWIDTH FILTER

BACKGROUND OF THE INVENTION

This invention relates generally to a speech processor and is more particularly concerned with a computer peripheral which allows the computer to digitally store audio signals and to reproduce the audio signal at a later time.

Information exchange between human beings often takes place in the form of audio communication, i.e., listening and talking. This form of communication is convenient and provides a rapid means of information transfer. Audio communication can also take place between humans and computers. Computer speech output can act as a low-cost indicating device replacing gauges, warning lights, and printers in many applications. Computer speech recognition can act as a low-cost input device, replacing keyboards. Computer speech input/output has an advantage over other forms of man-to-machine communication in that it occupies minimum physical volume. Hence, speech can be used where large keyboards and displays are unacceptable. Computer speech communication is also useful for "hands-off" communication of data, required in airline baggage sorting and wheelchair controls for the handicapped. A low-cost speech system can be used in games, toys, automobiles, consumer appliances, and many other cost-sensitive applications.

Present techniques of speech processing fall into two catagories. The first, called "Linear Predictive Coding" (LPC) essentially uses an electronic model of the human vocal tract to synthesize speech. Although recent developments in the LPC area promise to reduce the cost of speech production, speech recognition using this technique is presently (and will remain) quite costly. The LPC technique would have to be reduced in cost by several orders of magnitude before it could be useful as a speech input/output device in consumer products.

The second catagory of speech processor uses the "Time-Domain" technique. In this method, a speech waveform is generated by a human and this waveform is then sampled and stored as a series of numbers. The speech is reconstructed when these stored numbers are fed through an appropriate digital-to-audio conversion system. At present, a popular technique for accomplishing this is called "Continuously Variable Slope Delta" (CVSD) modulation. CVSD changes an audio signal into a serial binary data stream, but the value of each bit in the data stream (0 or 1) depends upon the value of the bits surrounding it in the data stream. Hence the CVSD data is in a highly encoded form, and cannot be directly used for automatic word recognition purposes by a computer. The invention of this application is a Time-Domain technique which differs significantly from CVSD.

BRIEF SUMMARY OF THE INVENTION

In a preferred embodiment of the invention the audio signal is bandwidth limited before being differentiated to provide either a positive or negative signal (depending on the slope of the audio signal) to a comparator which provides a corresponding logical one or zero at its output. A digital logic circuit connected to the comparator output is clocked to provide a digital output signal transition from a logical one to a zero or vice versa if its input has changed from a logical one to a zero or vice versa at least once during the clock period. The clocked digital output of the logic circuit is provided as an input to a computer where it is stored. The digital data is subsequently read out of the computer and provided to a filter and integrator to provide an audio signal replica of the filtered input audio signal.

It is an object of this invention accordingly to provide an economical means of converting the audible signals into a form of data which can be used by a computer to perform automatic pattern analysis. Another object of the invention is to provide a mass-producible audio signal processor which does not require individually-tuned filters or precision components. A further object of the invention is to provide an economical means of converting speech into digital form, and also to reconvert the digits into intelligible speech.

A feature of this invention is that the speech quality available is under user control since a faster data sampling rate gives better speech quality and therefore better recognition accuracy when the invention is used for automatic word recognition purposes. A sampling rate of five KHz results in marginally intelligible speech, ten KHz, a typical sampling rate, gives good intelligibility, and sixteen KHz results in a very high intelligibility and good quality.

A further feature of the invention is that slow and/or defective memory systems can be used in conjunction with it for purposes of data storage. Since the bit stream produced by the invention is not highly encoded, a few random failures in the stored data will not significantly degrade the signal quality.

A further feature of the invention is that the device produces a serial bit stream of data, such that each bit is independent from past and future data bits in the stream, and where the data from said device may be used for the purpose of automatic recognition of the serial bit stream.

A still further feature is the provision of an instantaneously variable bandwidth filter which reduces system noise by limiting the bandwidth of low-level inputs while allowing high-level inputs to pass through the filter unaffected by bandwidth limitations.

BRIEF DESCRIPTION OF THE DRAWINGS

These and other features of the invention will best be understood with the aid of the accompanying drawings in which:

FIG. 1 is a block diagram of the audio-to-digital and digital-to-audio conversion systems;

FIG. 2 is a schematic diagram of an instantaneously variable bandwidth filter;

DETAILED DESCRIPTION OF THE INVENTION

Figure 3:
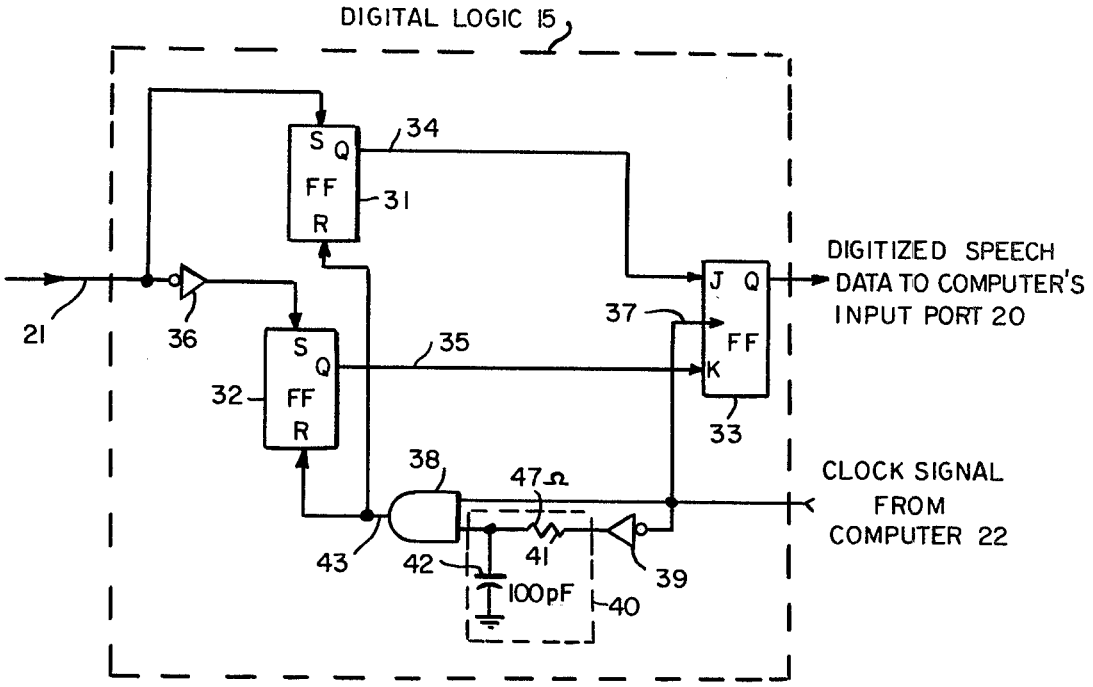
FIG. 3 is a block diagram of a digital logic circuit for use in the system of FIG. 1.

The preferred embodiment of the invention herein described is shown in block diagram form in FIG. 1. The audio-to-digital converter 9 is comprised of a low pass filter 11, an instantaneously variable bandwidth filter 12, a differentiator 13, a comparator 14, and digital logic 15. This system is attached to a computer 16 as a peripheral device. The digital-to-audio converter is comprised of a low-pass filter 17 and an integrator 18.

An audio signal 10 from any conventional source is applied to a low-pass filter 11 to eliminate frequency components above 3 KHz. This signal is then fed to an instantaneously variable bandwidth filter 12, a particular embodiment of which is shown in the schematic of FIG. 2 as a resistor 25 in series with an input of operational amplifier 28 having a feedback network 29 across the amplifier. When the signal input level to filter 12 is small, the diodes 26 and 27 of network 29 do not conduct and the filter's bandwidth is limited by its resistor 23 and capacitor 24. Typically, the bandwidth is about 2.5 KHz for low level inputs. This eliminates the high-frequency components of low-level noise. When a large signal is applied to filter 12, the diodes 26 and 27 conduct and present a low impedance in parallel with R 23. The filter then has a wide bandwidth, allowing audio signals to pass through it. The audio signal is then fed to a differentiator circuit 13 and to a comparator 14. The output of the comparator 14 will be a logical "ONE" whenever the audio signal input 10 has a positive-going slope, and the output of the comparator 14 will be a logical "ZERO" whenever the audio signal input 10 has a negative-going slope. This rough estimate of the characteristics of the audio signal input 10 is sufficient to preserve many important features of the signal, including intelligibility when the audio signal input 10 is a speech waveform. The digital logic circuit 15 serves to synchronize the speech waveform with the computer clock 22. The output signal on line 20 of the digital logic 15 changes (from ONE to ZERO or from ZERO to ONE) at the end of a clock period only if the input signal on line 21 to the digital logic 15 from the comparator 14 has changed one or more times during that clock period. The digital data on line 20 in the form of a ONE or ZERO is stored in the memory of the computer according to its value at each clock pulse. Once the data has been stored in the computer 16 it can be reconverted into an audio signal output 19 by reading it out of the computer memory at the clock pulse rate and passing it through a low-pass filter 17 and an integrator 18. The reconversion of data into speech allows the invention to be used in a "digital tape recorder" type of application, for computer speech output purposes. It is seen that for the purpose of speech storage the computer may use a memory having defective memory positions since the loss of data for a clock pulse period will minimally affect intelligibility of the reproduced speech.

As stated previously, the digital logic circuit 15, shown in detail in FIG. 3, provides a change in the digital state of its output 20 when its input 21 has experienced one or more changes in its digital logic level, i.e., from ONE to ZERO or from ZERO to ONE, in the period of the clock signal 22 from the computer 16.

Figure 4:
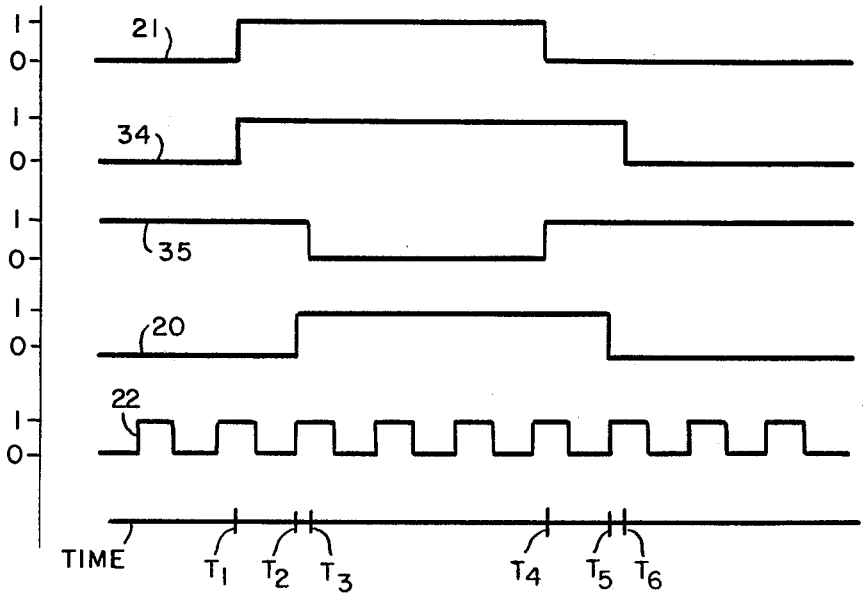
FIG. 4 is a timing diagram of the operation of the digital logic circuit.

Assume that the logic signal on line 21 is ZERO, that the output of SR flip-flop 31 is providing a ZERO input on line 34, and that the output of SR flip flop 32 is providing a ONE output on line 35 as shown at the leftmost portion of the timing diagram of FIG. 4 which illustrates the operation of the digital logic circuit 15 described in the following paragraphs. The lines 34, 35 provide the inputs to the J, K inputs, respectively, of the edge-triggered JK flip-flop 33 whose output on line 20 is assumed to be low.

The clock signals 22 on the line from the clock pulse source of computer 16 are applied to switching input 37 of JK flip-flop 33. For the assumed input and output states of the JK flip-flop 33, one or more subsequent clock signals will not trigger a change in the state of the JK flip-flop and the output 20 will remain ZERO.

If it is next assumed that the voltage input from differentiator 13 becomes positive, the logic signal from the comparator 14 output will provide a ONE input on line 21 at time T1. This ONE input signal is applied to the "set" input of flip-flop 31 and causes its output 34 to be ONE thereby providing both the J and K input to flip-flop 33 with a ONE input. The positive going edge, at time T2, of the next clock signal from the computer 16 on line 22 is provided to input 37 of flip-flop 33 and causes its output 20 to switch or toggle from its assumed ZERO level to a ONE level because both the J and K inputs are ONE at that time.

The clock signal 22 is also applied directly as an input to AND gate 38 and to the other input of the AND gate 38 after inversion in inverter 39 whose output is provided to the pulse forming circuit 40. Circuit 40 is comprised of a resistor 41 and capacitor 42 arranged as an integrator. At the end of the ZERO portion of the clock signal 22 the capacitor 42 has a positive charge. When the clock signal goes to ONE, a positive voltage, the positive clock pulse 22 and the positive voltage of capacitor 42, applied as inputs to AND gate 38, causes its output 43 to be a ONE and apply a reset pulse to the "reset" terminal R of flip-flops 31, 32. The positive voltage on capacitor 42 discharges through resistor 41 to produce a reset pulse 43 of approximately 100 nanoseconds thereby allowing either flip-flop 31 or 32 to be set by a ONE input signal if applied to their respective set terminals S during the remainder of the clock pulse period when the reset pulse 43 is absent. Since the logic signal input on line 21 is ONE the output 34 of flip-flop 31 will remain a ONE after a reset pulse 43, but the output 35 of flip-flop 32 will become a ZERO (at time T3) immediately after the JK flip-flop 33 has switched because its input is a ZERO at the time of occurrence of the reset pulse.

Assuming no change in the level of the logic signal 21 for the next few clock periods the output 20 of the JK flip-flop 33 remains a ONE. If the logic signal 21 subsequently changes from a ONE input to a ZERO input at time T4 because of a change in the input signal 10, the output 35 of flip-flop 32 becomes a ONE at that time and the output 34 of flip-flop 31 remains a ONE. The next positive-going edge (a transition from a ZERO to a ONE) at time T5 of the clock signal 22 causes the JK flip-flop 33 output 20 to switch or toggle to become a ZERO. Shortly thereafter (at time T6) the reset pulse 43 provided to the flip-flops 31 and 32 causes the ONE output 34 of flip-flop 31 to become a ZERO and the output 35 of flip-flop 32 to be unaffected and to remain a ONE because of the ONE applied to its set input. At this time, the assumed initial conditions have been re-established and the cycle will be repeated for subsequent changes in the level of the logic signal 21 caused by slope changes in the input signal 10.

Although the preceding explanation has assumed only one transition of a logic signal 21 between the positive going edges of the clock signal 22, it will be apparent that more transitions of the logic signal 21 during that same clock period will not change the operation from that described inasmuch as flip-flops 31 and 32 make only one transition from a ZERO to a ONE output during a clock period regardless of the number of times that the set input may be a ONE during that clock pulse period. Therefore, logic circuit 15 output 20 changes only once from a ONE to a ZERO, or vice versa, and at the end of a clock period even though the input signal 21 from comparator 14 may have had more than one logic level change during that clock period.

At this point, the usefulness of the instantaneous variable bandwidth filter becomes apparent because high-frequency components of low-level noise could otherwise cause the comparator 14 to switch at least once per clock cycle, which in turn will cause a square wave to be always produced at one-half the clock frequency at the digital circuit 15 output 20. It should be noted that the gain for low-level signals is determined by the ratio of resistor 23 to resistor 25 of FIG. 2. This ratio should be low for acceptable operation, otherwise the gain compression inherent in this design could cause undesirable amplification of the low level noise signals. Typically, a low level signal gain of about ten and with substantially unity gain at signal levels which cause diodes 26 and 27 to conduct has been found satisfactory.

It is evident that those skilled in the art, once given the benefit of the foregoing disclosure, may make numerous other uses and modifications of, and departures from the specific embodiments described herein without departing from the inventive concepts. Consequently, the invention is to be construed as embracing each and every novel combination of features present in, or possessed by, the apparatus and techniques herein disclosed and limited solely by the scope and spirit of the appended claims.

What is claimed is:

1. An audio signal digitization circuit comprising:

means for instantaneously limiting the bandwidth of said audio signal to provide a greater bandwidth for audio signals above a predetermined amplitude, first means for providing a signal whose logic level is responsive to the polarity of the slope of the output signal from said bandwidth limiting means, a source of clock signals, second means for providing an approximate digital output signal whose logic level changes in response to said logic level signal from said first means and to a clock signal from said source where said first means for providing a signal provides one or more changes in logic level to said second means in the period between said clock signals.

2. The audio signal digitization circuit of claim 1 comprising in addition storage means responsive to said digital output signal and said clock signals to store the logic level of said digital output signal corresponding to its value during each period of the clock signal, means for reading out from said storage means said stored logic levels of said digital output signal to provide a replica of said digital input signal.

3. The audio signal reproduction circuit comprising the digitization circuit of claim 1 and in addition means for low-pass filtering said digital output signal, means for integrating said filtered digital output signal to provide a replica of the audio signal.

4. The audio signal reproduction circuit comprising the digitization circuit of claim 2 and in addition means for low-pass filtering said digital output signal, means for integrating said filtered digital output signal to provide a replica of the audio signal.

5. The audio signal digitization circuit of claims 1 or 2 wherein said bandwidth limiting means comprises a low-pass filter, an instantaneously-variable bandwidth filter in cascade with said low-pass filter and whose bandwidth is responsive to the amplitude of the audio signal.

6. The audio signal digitization circuit of claims 1 or 2 wherein said first means for providing a signal whose logic level is responsive to the slope of the output signal from said bandwidth limiting means comprises, a differentiator connected to the output of said bandwidth limiting means to provide a signal output having a positive or negative polarity in accordance with the slope of the input signal to said differentiator, a comparator responsive to the output signal of said differentiator to provide a digital signal output of one logic level for a positive polarity differentiator output signal and an output of a different logic level for a negative polarity differentiator output signal.

* * * * *